United States Patent [19]

Meier

[11] 4,299,148

[45] Nov. 10, 1981

[54] METHOD FOR CUTTING AND MAINTAINING SEPARATE SEGMENTS OF A GUMMOUS COMESTIBLE

[76] Inventor: Gerard B. Meier, 280 Hight Crest Dr., West Milford, N.J. 07480

[21] Appl. No.: 894,058

[22] Filed: Apr. 6, 1978

[51] Int. Cl.[2] ..... B26D 3/24

[52] U.S. Cl. ..... 83/34; 30/114; 33/174 T; 53/435; 53/516; 83/168; 83/547

[58] Field of Search ..... 83/34, 168, 547; 30/114, 115; 33/174 T; 269/1; 99/537; 426/503, 518

[56] References Cited

U.S. PATENT DOCUMENTS

| | | | |
|---|---|---|---|
| 1,297,671 | 3/1919 | Fairbank | 33/174 T |
| 1,629,164 | 5/1927 | Hughes | 30/114 X |
| 2,339,584 | 1/1944 | Rice | 53/435 X |
| 3,026,657 | 3/1962 | Williams et al. | 53/435 X |
| 3,132,678 | 5/1964 | Steketer | 33/174 T |
| 4,060,017 | 11/1977 | Backlund | 83/547 X |
| 4,075,359 | 2/1978 | Thulin | 426/518 X |

FOREIGN PATENT DOCUMENTS

| | | | |
|---|---|---|---|
| 619678 | 4/1961 | Italy | 30/114 |

*Primary Examiner*—J. M. Meister

*Attorney, Agent, or Firm*—Mel K. Silverman; Mahendra A. Gandhi

[57] ABSTRACT

A method for cutting and maintaining in separate segments a gummous comestible, comprising the steps of: (a) positioning a disk-like template above the comestible, the template having a plurality of radiating extending slots; (b) positioning a cutting tool above one of the slots; (c) folding a sheet of wax-like material over the cutting edge of said tool and about both sides thereof; (d) simultaneously holding each side of said wax-like sheet against the sides of the tool and pressing said closely held sheet and tool into the gummous comestible; (e) withdrawing the cutting tool while permitting the material, as a result of the friction and surface tension of said gummous comestible thereagainst, to remain in the gummous comestible; and (f) repeating each of the above steps for each of the radiating extending slots of the template through which a corresponding cut and placement of the wax-like sheet material is desired, whereby a separation into segments, in accordance with the relative position of each of the extending slots of the template, is obtained through the above steps such that the comestible may be packaged or served in a fashion which will provide for separation of each of the respective segments of the comestible without loss of freshness or other desirable characteristics of the comestible.

3 Claims, 1 Drawing Figure

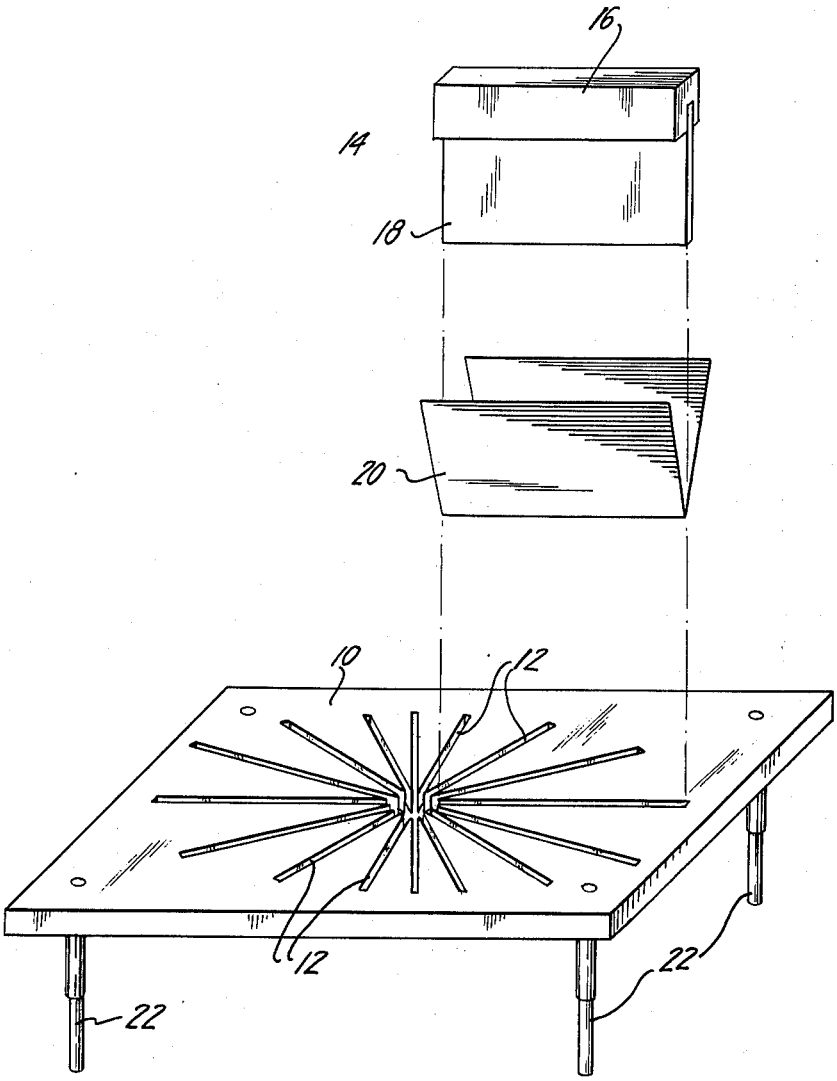
16
14
18
20
10
12
12
22
22

METHOD FOR CUTTING AND MAINTAINING SEPARATE SEGMENTS OF A GUMMOUS COMESTIBLE

BACKGROUND OF THE INVENTION

The present invention relates to means for cutting and maintaining in separate segments various parts of an edible assembly such as a cake or pie and, more particularly, pies such as lemon meringue and chocolate. This category includes rather sticky or gooey cakes, pies, and pastries.

The prior art in the present area has shown the use of templates or, as they are generally known, pastry cutting guides which, for example, are characterized by U.S. Pat. No. 1,297,671 (1919) to Fairbank. Devices of the class of Fairbank have, over the years, been generally utilized in order to provide a means for cutting pies, cakes, pastries, or other foods, in radially symmetric and segmented fashion which, thereby, is both aesthetically pleasing and provides for equal segments of each piece as, generally, is necessary in restaurants and other areas.

Additionally, pie cutting means adapted for radially disposed incisions in a pie, in combination with a pie-cutting plate, have appeared in such patents as U.S. Pat. No. 2,605,547 (1952) to Tweeten. Tweeten, while clearly related to the present invention, does not, as is often desired in the baking and pastry goods field, provide for a simple and effective means for maintaining the separation between respectively cut radial segments and, concurrently, maintaining a "sealed in" freshness to the individual pieces during packaging and shipment followed by a period of shelf time. Additionally, it is noted that the invention to Tweeten, as in the case of others of its nature, presents a sanitation problem in that upon each cut by the cutting gauge, foreign material from and upon the gauge or knife may be imparted to the pie and, in like fashion, material from the pie may be imparted to the cutting blade. Also, the sharpness of the cut will become impaired as a build-up of comestible material on the blade occurs.

In view of the above shortcomings in the prior art, it is to be appreciated that an object of the present invention is to provide a "clean release" means for the cutting of a gummous comestible into a plurality of segments.

A further object is to provide a sanitary means of cutting such gummous comestible.

A still further object is to provide a convenient method for maintaining in separated segments the "sealed in goodness" of baked goods under conditions of packaging, shipment, and an extended shelf life.

It is to be appreciated that other objects will become apparent from the hereinafter set forth description of the invention.

SUMMARY OF THE INVENTION

The present invention relates to a method for cutting and maintaining in separate segments a gummous comestible, such as a pie, comprising the steps of: positioning a disk-like template above the comestible, said template having therein a plurality of radiating extending slots; positioning a cutting tool having a length corresponding to the length of said radiating extending slots, above one of said slots; folding a sheet of wax-like material over the cutting edge of said cutting tool, said fold extending about each of the sides of said tool; simultaneously holding said sheet of wax-like material about each side of said cutting tool and passing said cutting tool and wax-like sheet of material through one of said radiating extending slots and into the gummous comestible; withdrawing said cutting tool while permitting, by release thereof, said wax-like sheet of material to remain embedded in said gummous comestible in the position defined by its passage the radiating slot; and repeating each of said steps with respect to each radiating slot and corresponding position over the comestible material for which a cut and respective separated segment of the comestible is desired.

BRIEF DESCRIPTION OF THE DRAWINGS

The FIGURE is a perspective view of the template, cutting tool, and sheet of wax-like material utilized in the practice of the present method.

DETAILED DESCRIPTION OF THE INVENTION

With reference to the FIGURE, it may be seen that a template 10 having a plurality of radiating slots 12 is provided. While each of the slots shown in the FIGURE is separated by an equal angular distance, it is to be appreciated that other slot arrangements may, in an appropriate application, be provided for by the template.

Also shown in the FIGURE is a cutting tool 14 which tool is provided with a holding element 16 and a blade element 18. Also provided is a sheet of wax-like material 20 which, as may be noted, can be folded in a fashion which, when placed in abutment to the blade 18, will essentially conform to the shape thereof.

With further regard to the template 10, it is to be noted that, in a further embodiment, each of the corners of the template may be provided with a leg 22 so as to enable the template to be supported over the gummous comestible. Additionally, each of said legs may be of a telescoping nature so as to provide adjustability with respect to the height of the cake or pie. With regard to the steps employed in the present novel method, the template 10 is, whether with or without usage of the above-mentioned supporting legs, positioned over the gummous comestible. Secondly, a cutting tool 14 is positioned over one of the radiating slots 12. Thirdly, the wax-like sheet of material 20 is folded about the edge of the cutting tool 18.

Thereafter, while holding the wax-like material against the left and right sides of the cutting edge 18, the combination of the wax-like material 20 and the cutting tool 14 is passed through the desired radial slot 12 and into the gummous material. Thereupon, the wax paper 20 is released from finger pressure allowing the cutting tool 16 to be freely removed while the sheet 20 remains as a separating and flavor-freshness sealing means with respect to each of the sliced segments of the comestible.

After repeating of the above steps with respect to all of the desired segments, the comestible may be placed within an appropriate packaging or box for purposes of shipment and later shelf storage, while the individual pie slices remain separated and freshness-sealed by the sheet 20.

Accordingly, while there have been shown and described the preferred embodiments of the present invention, it will be understood that the invention may be embodied otherwise than as herein specifically illustrated or described and that within said embodiments certain changes in the detail and construction, and the form of arrangement of the parts may be made without departing from the underlying idea or principles of this invention within the scope of the appended claims.

Having thus described my invention what I claim as new, useful and non-obvious and accordingly secure by Letters Patent of the United States is:

1. In a method for cutting and maintaining in separate segments a gummous comestible, such as a pie, wherein a cutting tool having appropriate length is positioned to cut the segments of said comestible, the improvement comprising the steps of:

(a) positioning a disc-like template above the comestible, said template having therein a plurality of radiating extending slots;

(b) folding a sheet of wax-like material over a cutting edge of said cutting tool said fold extending about each of the sides of said tool;

(c) simultaneously holding said sheet of wax-like material above each side of said cutting tool and passing said cutting tool and wax-like sheet of material through one of said radiating extending slots and into the gummous comestible;

(d) permitting said wax-like sheet of material to remain embedded in said gummous comestible in the position defined by its passage through the radiating slot; and (e) repeating each of said steps with respect to each radiating slot and each corresponding position over the comestible material for which a cut and respective separated segment of the comestible is desired.

2. The method as recited in claim 1 in which said method further comprises:

adding leg-like supports to each corner of said template.

3. The method as recited in claim 1 in which said method further comprises:

providing telescoping leg-like supports to each corner of said template.

* * * * *